US011337871B2

(12) United States Patent
Henise et al.

(10) Patent No.: US 11,337,871 B2
(45) Date of Patent: May 24, 2022

(54) WHEELCHAIR ADORNMENT SYSTEM

(71) Applicants: Tisha Henise, York, PA (US); Samantha Henise, York, PA (US)

(72) Inventors: Tisha Henise, York, PA (US); Samantha Henise, York, PA (US)

( * ) Notice: Subject to any disclaimer, the term of this patent is extended or adjusted under 35 U.S.C. 154(b) by 0 days.

(21) Appl. No.: 17/032,632

(22) Filed: Sep. 25, 2020

(65) Prior Publication Data

US 2022/0096293 A1 Mar. 31, 2022

(51) Int. Cl.
*A61G 5/10* (2006.01)
*A61G 5/02* (2006.01)

(52) U.S. Cl.
CPC ..... *A61G 5/1043* (2013.01); *A61G 5/02* (2013.01)

(58) Field of Classification Search
CPC ..... A61G 5/1043; A61G 5/02; A61G 5/10; A61G 5/125; A61G 2203/70; A61G 2203/723; A47C 7/626; A47C 29/00; B62B 9/14
See application file for complete search history.

(56) References Cited

U.S. PATENT DOCUMENTS 2,088,557 A * 7/1937 Grant ..... B62B 9/14 296/110
D123,371 S 4/1941 Schnack
2,546,843 A * 3/1951 Zigterman ..... B62B 9/145 5/416
2,891,604 A * 6/1959 Soucie ..... A47C 7/546 297/411.26
3,071,782 A * 1/1963 Ball ..... A47D 7/002 5/97
3,103,386 A * 9/1963 Kerr ..... A61G 15/10 297/411.46
3,189,384 A * 6/1965 Bliss ..... A61G 5/12 297/423.33
3,231,293 A * 1/1966 Loustaunau ..... A61G 5/10 280/211
3,863,984 A * 2/1975 Sickels ..... A61G 5/12 297/423.17
4,996,977 A * 3/1991 Tiedeken ..... A61F 5/3761 128/878
5,074,617 A * 12/1991 Maxwell ..... A61G 5/125 297/188.18
5,405,109 A * 4/1995 Nordnes ..... A47B 21/0371 248/118.3
D376,775 S 12/1996 Fang
(Continued)

FOREIGN PATENT DOCUMENTS

CN 2657634 Y * 11/2004
CN 202027822 U * 11/2011
(Continued)

*Primary Examiner* — Steve Clemmons

(57) ABSTRACT

A wheelchair adornment system includes a wheelchair has a pair of wheels, a pair of arm rests, a pair of leg supports, a chair and a backrest. A plurality of guards is provided and each of the guards is removably coupled to a selected point on the wheelchair. Thus, each of the guards may conceal associated parts of a user's body. A pair of fenders is provided and each of the fenders is coupled to the wheelchair. Each of the fenders is positioned over an associated one of the wheels. A canopy is removably coupled to the wheelchair configured to shade the user.

15 Claims, 5 Drawing Sheets

(56) References Cited

U.S. PATENT DOCUMENTS

| | | | | | |
|---|---|---|---|---|---|
| 5,713,591 | A * | 2/1998 | Zarkhin | A61G 5/12 | 248/118.3 |
| 5,842,745 | A * | 12/1998 | Kelly | A61G 5/1094 | 297/411.23 |
| 5,921,258 | A * | 7/1999 | Francois | A61G 5/10 | 135/88.03 |
| 6,032,972 | A | 3/2000 | Dias | | |
| 6,439,281 | B1 | 8/2002 | Hogg | | |
| 6,517,443 | B1 | 2/2003 | Villella | | |
| 6,702,314 | B1 | 3/2004 | Crose | | |
| 6,708,935 | B2 * | 3/2004 | Smeed | A61G 5/12 | 128/878 |
| 6,857,649 | B2 | 2/2005 | Patton | | |
| 7,980,581 | B2 * | 7/2011 | Buckner | B62J 27/00 | 280/304.3 |
| 8,997,770 | B1 * | 4/2015 | Martin | A47C 7/66 | 135/96 |
| 9,095,484 | B1 * | 8/2015 | Bethea | A61G 5/128 | |
| 9,474,667 | B1 * | 10/2016 | Gruber | A61G 5/1054 | |
| D874,353 | S * | 2/2020 | Buckner | D12/133 | |
| D874,354 | S * | 2/2020 | Buckner | D12/133 | |
| 10,681,988 | B2 * | 6/2020 | Andrews | A45F 3/14 | |
| 10,806,650 | B2 * | 10/2020 | Di Lauro | A61G 13/101 | |
| 2002/0125711 | A1 * | 9/2002 | Calhoun | A61G 5/028 | 280/848 |
| 2002/0167149 | A1 | 11/2002 | Mavrinac | | |
| 2004/0041449 | A1 | 3/2004 | Bluhm | | |
| 2007/0120398 | A1 * | 5/2007 | Butler | A61G 5/125 | 297/153 |
| 2010/0078053 | A1 | 4/2010 | Hughes | | |
| 2011/0297198 | A1 * | 12/2011 | Sibley | A61G 15/10 | 135/88.01 |
| 2015/0296990 | A1 * | 10/2015 | Malik | A61G 5/10 | 280/47.38 |
| 2016/0166450 | A1 * | 6/2016 | Graffy | A47G 23/0225 | 248/207 |

FOREIGN PATENT DOCUMENTS

| | | | | | |
|---|---|---|---|---|---|
| CN | 203988732 | U | * | 12/2014 | |
| CN | 212547442 | U | * | 2/2021 | |
| CN | 213553034 | U | * | 6/2021 | |
| DE | 19929743 | A1 | * | 3/2000 | B60B 7/00 |
| GB | 2366254 | A | * | 3/2002 | B62B 9/14 |
| GB | 2482695 | A | * | 2/2012 | A45B 25/02 |
| GB | 2491959 | A | * | 12/2012 | B62B 9/14 |
| GB | 2524253 | A | * | 9/2015 | A61G 5/10 |
| GB | 2528763 | A | * | 2/2016 | B62B 9/142 |
| GB | 2589619 | A | * | 6/2021 | |
| KR | 102208937 | B1 | * | 1/2021 | |

* cited by examiner

WHEELCHAIR ADORNMENT SYSTEM

BACKGROUND OF THE DISCLOSURE

Field of the Disclosure

The disclosure relates to adornment devices and more particularly pertains to a new adornment device for enhancing an appearance of a user in a wheelchair.

SUMMARY OF THE DISCLOSURE

An embodiment of the disclosure meets the needs presented above by generally comprising a wheelchair has a pair of wheels, a pair of arm rests, a pair of leg supports, a chair and a backrest. A plurality of guards is provided and each of the guards is removably coupled to a selected point on the wheelchair. Thus, each of the guards may conceal associated parts of a user's body. A pair of fenders is provided and each of the fenders is coupled to the wheelchair. Each of the fenders is positioned over an associated one of the wheels. A canopy is removably coupled to the wheelchair configured to shade the user.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
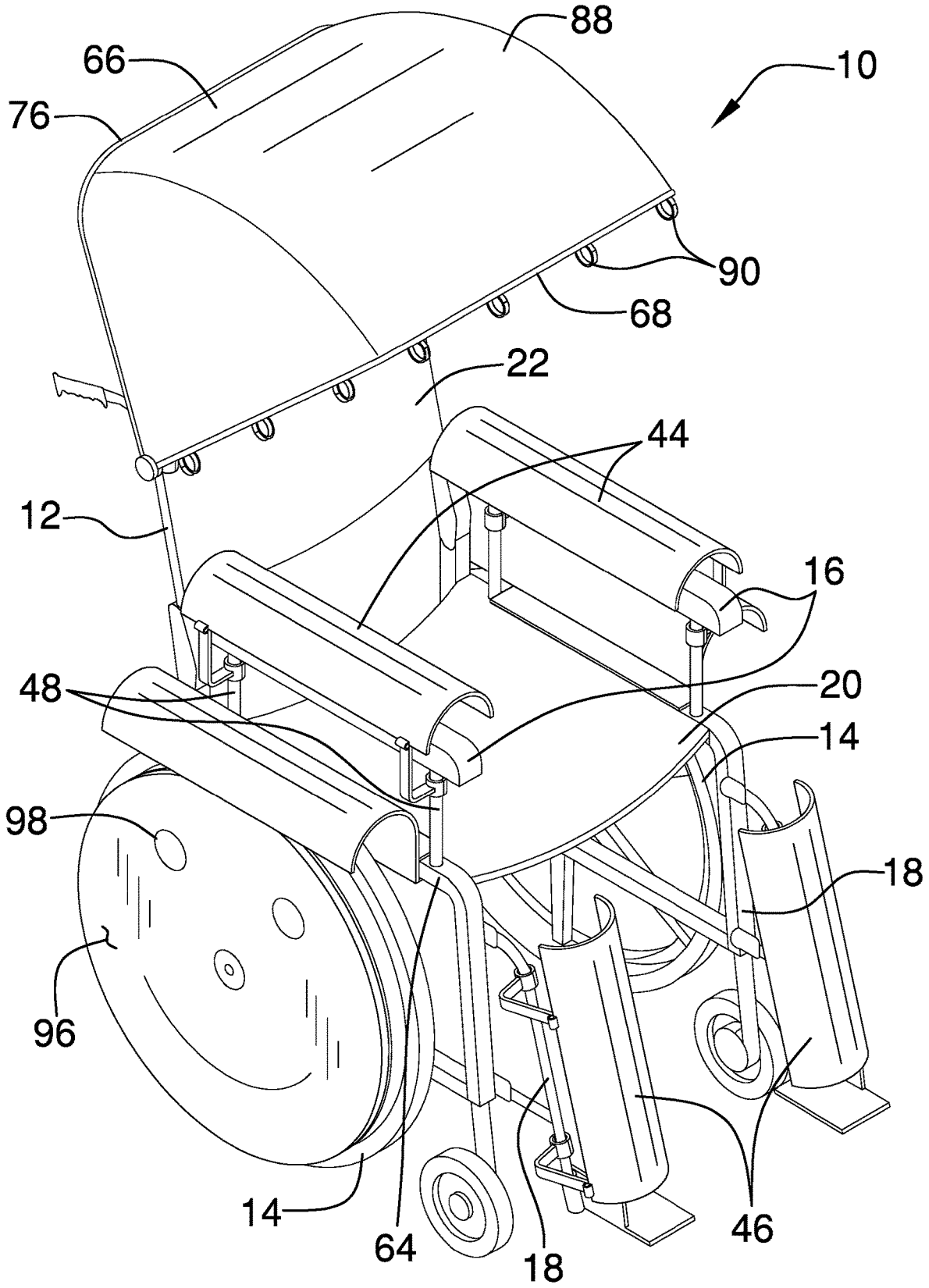
FIG. 1 is a top perspective view of a wheelchair adornment system according to an embodiment of the disclosure.
Figure 2:
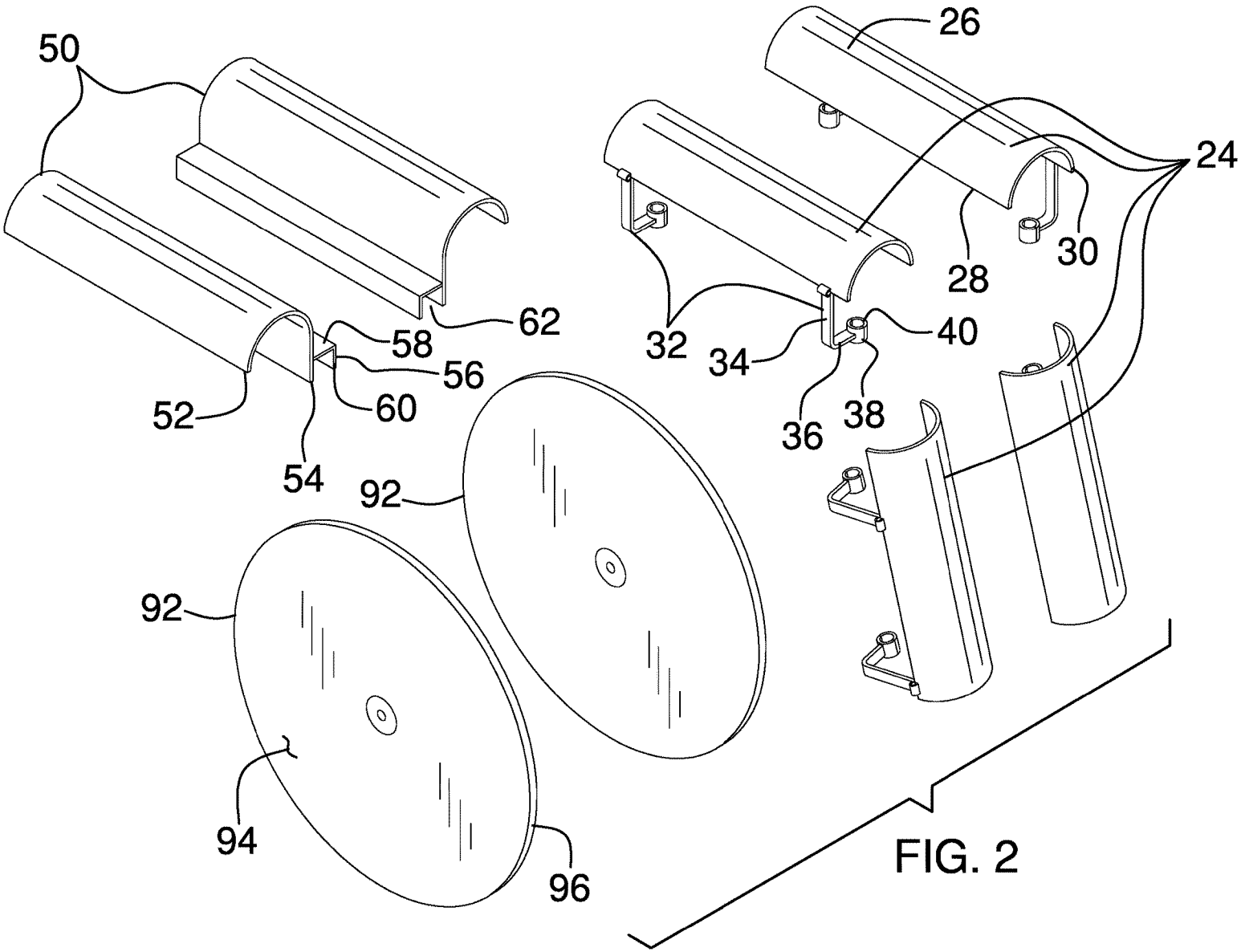
FIG. 2 is a perspective view of an embodiment of the disclosure.
Figure 3:
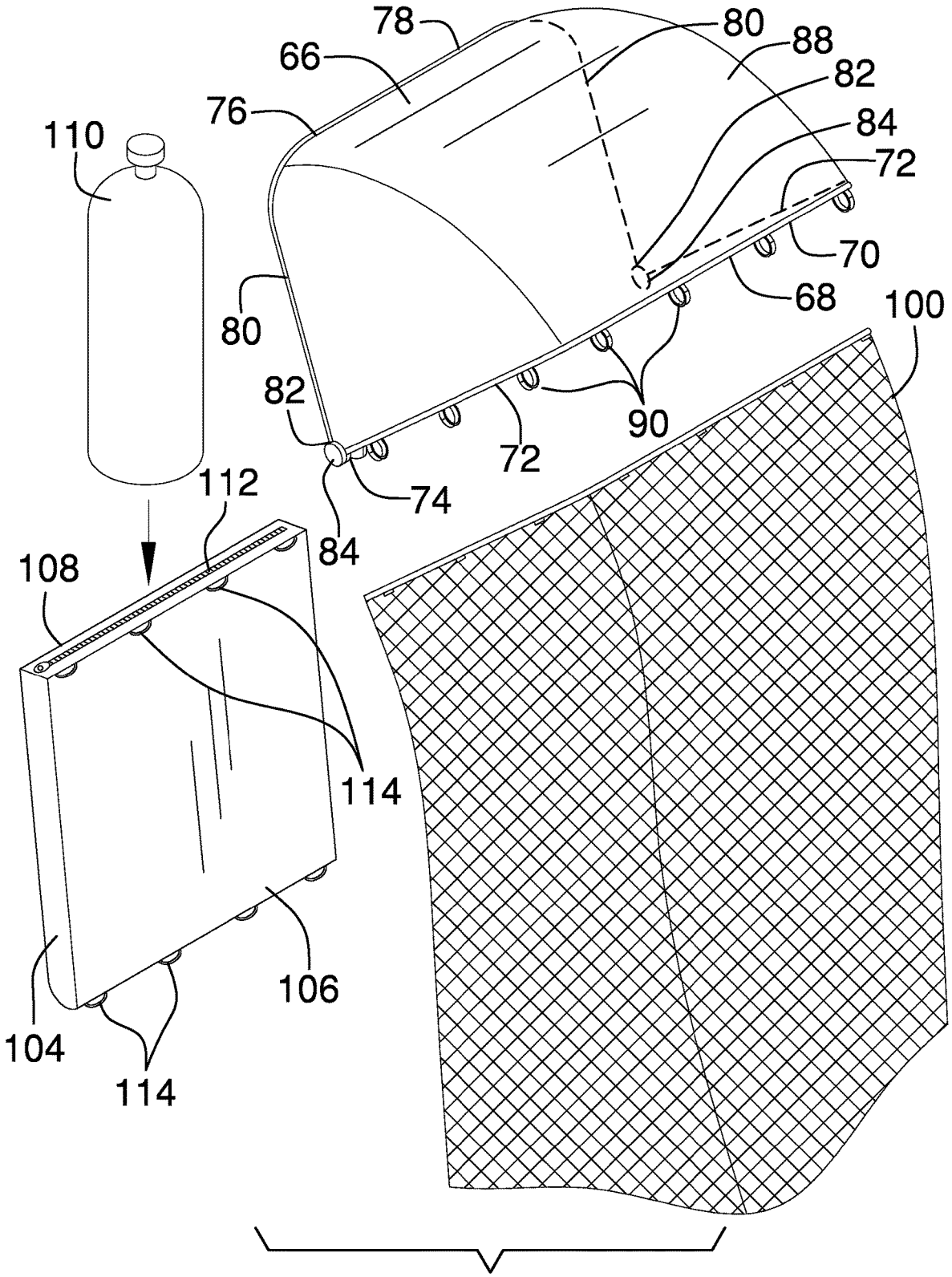
FIG. 3 is a perspective view of a canopy, a net and a pouch of an embodiment of the disclosure.
Figure 4:
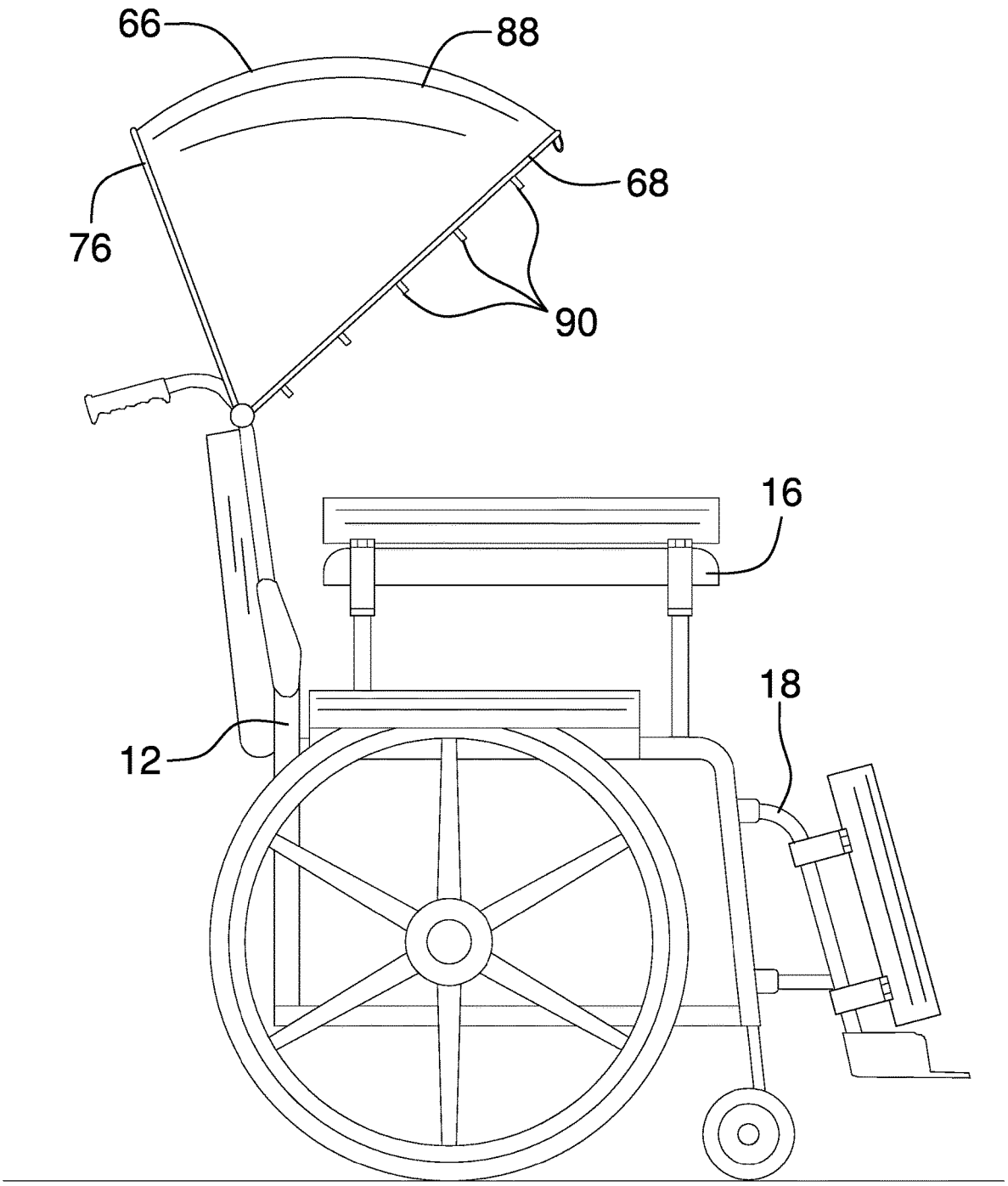
FIG. 4 is a right side view of an embodiment of the disclosure.
Figure 5:
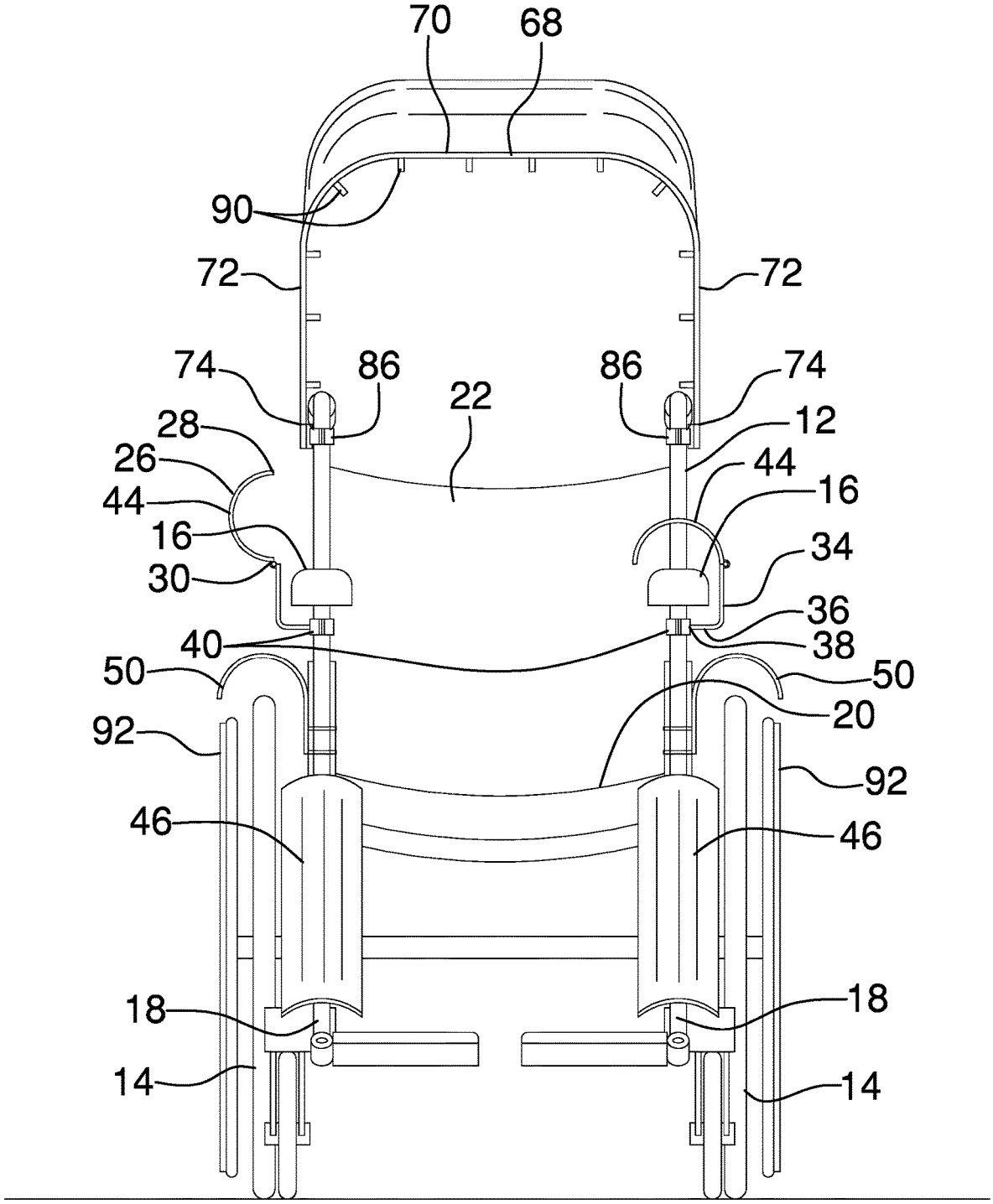
FIG. 5 is a front view of an embodiment of the disclosure.

With reference now to the drawings, and in particular to FIGS. 1 through 5 thereof, a new retention device embodying the principles and concepts of an embodiment of the disclosure and generally designated by the reference numeral 10 will be described.

As best illustrated in FIGS. 1 through 5, the wheelchair adornment system generally comprises a wheelchair 12. The wheelchair 12 has a pair of wheels 14, a pair of arm rests 16, a pair of leg supports 18, a chair 20 and a backrest 22. The wheelchair 12 may be a wheelchair 12 of any conventional design.

A plurality of guards 24 is provided. Each of the guards 24 is removably coupled to a selected point on the wheelchair 12. Thus, each of the guards 24 conceals associated parts of a user's body. The user may be a disabled user with deformed limbs. Each of the guards conceals the limbs. Thus, the guards 24 enhance the user's self esteem with respect to other people observing the user's deformed limbs.

Each of the guards 24 comprises a panel 26 that has a first lateral edge 28 and a second lateral edge 30. Each of the panels is concavely arcuate between the first lateral edge 28 and the second lateral edge 30. Thus, the first lateral edge 28 is spaced from the second lateral edge 30. Each of the guards 24 has a trough shape.

Each of the guards 24 includes a pair of mounts 32. Each of the mounts 32 has a leg 34 and a foot 36. The leg 34 corresponding to each of the mounts 32 is hingedly coupled to the first lateral edge 28. The foot 36 corresponding to each of the mounts 32 is spaced from the corresponding mount 32. The foot 36 corresponding to each of the mounts 32 has a distal end 38 with respect to the leg 34 of the corresponding mount 32.

A ring 40 is coupled to the distal end 38 of the foot 36 of the corresponding mount 32. The ring 40 is split into a pair of halves 42. Thus, the halves 42 of each ring 40 are urgeable away from each other. Thus, the ring 40 engages the wheelchair 12 such that the panel 26 is retained on the wheelchair 12.

The plurality of guards 24 includes a pair of arm guards 44 and a pair of leg guards 46. The ring 40 of each of the mounts 32 corresponding to each of the arm guards 44 is coupled to an associated one of a pair of supports 48 of an associated one of the arm rests 16. Each of the arm guards 44 is horizontally oriented on the wheelchair 12. The panel 26 of the corresponding mount 32 is spaced from the associated arm rest 16. Thus, each of the arm guards 44 may conceal an associated one of the user's arms.

The ring 40 of each of the mounts 32 corresponding to each of the leg guards 46 is coupled to an associated one of the leg supports 18. Each of the leg guards 46 is vertically oriented on the associated leg 34 support. The panel 26 of the corresponding mount 32 is spaced from the associated leg 34 support. Thus, each of the leg guards 46 may conceal an associated one of the user's legs.

A pair of fenders 50 is provided and each of the fenders 50 is coupled to the wheelchair 12. Each of the fenders 50 is positioned over an associated one of the wheels 14. Each of the fenders 50 has a primary lateral edge 52 and a secondary lateral edge 54. Each of the fenders 50 is concavely arcuate between the primary lateral edge 52 and the secondary lateral edge 54.

Each of the fenders 50 includes a grip 56. The grip 56 corresponding to each of the fenders 50 is coupled to and is coextensive with the corresponding fender 50. The grip 56 corresponding to each of the fenders 50 has a leg 58 and a foot 60. The foot 60 corresponding to each of the fenders 50 is spaced from the corresponding fender 50. Thus, a frame space 62 is defined in the corresponding fender 50. The frame space 62 of the corresponding fender 50 receives a frame 64 of the wheelchair 12 such that each of the fenders 50 is retained on the wheelchair 12.

A canopy 66 is provided. The canopy 66 is removably coupled to the wheelchair 12 to shade the user. The canopy 66 comprises a first frame 68 that has a central arm 70 extending between a pair of outward arms 72. The outward arms 72 are spaced from each other. Each of the outward arms 72 has a distal end 74 with respect to the central arm 70.

The canopy 66 includes a second frame 76 that has a middle arm 78 extending between a pair of outside arms 80. The outside arms 80 are spaced apart from each other. Each of the outside arms 80 has a distal end 82 with respect to the middle arm 78. The distal end 82 corresponding to each of the outside arms 80 is hingedly coupled to the distal end 74 corresponding to an associated one of the outward arms 72. Thus, a pair of hinge points 84 is defined on the canopy 66.

A pair of brackets 86 is provided. Each of the brackets 86 is coupled to an associated one of the hinge points 84. Each of the brackets 86 engages the back rest on the wheel chair 20. Thus, the canopy 66 extends upwardly from the back rest 22.

A cover 88 is coupled between the first frame 68 and the second frame 76. Thus, the cover 88 shades the user. The cover 88 is comprised of a deformable material. The canopy 66 is selectively positioned in a stored position having the first frame 68 abutting the second frame 76. The canopy 66 is selectively positioned in a deployed position having the first frame 68 being spaced from the second frame 76.

A plurality of fasteners 90 is provided. Each of the fasteners 90 is coupled to the first frame 68. The fasteners 90 are spaced apart from each other and are distributed along the first frame 68. Each of the fasteners 90 may comprise a hook and loop strap or the like.

A pair of disks 92 is provided. Each of the disks 92 has a first surface 94 and a second surface 96. Each of the disks 92 is removably coupled to an associated one of the wheels 14 on the wheelchair 12. The first surface 94 of each of the disks 92 abuts the associated wheel 14. Each of the disks 92 may be coupled to the associated wheel 14 with a bolt or the like.

The second surface 96 of each of the disks 92 has indicia 98 printed thereon. The indicia 98 comprise an image. Thus, each of the disks 92 enhances an ornamental appearance of the wheelchair 12. The indicia may be a smiling face or any other selected image.

A net 100 is removably coupled to the fasteners 90 on the first frame 68. The net 100 substantially surrounds the wheelchair 12. Thus, the net 100 inhibits insects from biting the user. Moreover, the net 100 inhibits debris from striking the user.

A pouch 104 is secured to a bottom side of the chair 20. The pouch 104 has a top side 106 and a first edge 108. The first edge 108 is open to access an interior of the pouch 104 and the first edge 108 may receive an object 110. The object 110 may be an oxygen bottle or other object 110 commonly employed by a disabled person. A closure 112 is movably coupled to the first edge 108 and the closure 112 may be manipulated. The closure 112 selectively closes the first edge 108 and the closure 112 may comprise a zipper or the like.

A plurality of hangers 114 is provided. Each of the hangers 114 is coupled to the top side 106 of the pouch 104. The hangers 114 are spaced apart from each other and are distributed around a perimeter of the pouch 104. Each of the hangers 114 engages the bottom side of the chair 20.

In use, each of the arm guards 44 is positioned in an open position to facilitate each of the user's arms to be positioned on an associated arm rest 16. Each of the arm guards 44 is positioned in a closed position. Thus, each of the arm guards 44 covers the associated one of the user's arms. Each of the leg guards 46 is positioned in an open position to facilitate each of the user's legs to be positioned on an associated leg supports 18. Each of the leg guards 46 is positioned in a closed position. Thus, each of the leg guards 46 covers the associated one of the user's legs.

The canopy 66 is selectively positioned in the deployed position to shade the user. The net 100 is selectively coupled to the canopy 66 when the canopy 66 is in the deployed position. Each of the disks 92 is selectively coupled to the associated wheel. The pouch 104 is secured to the bottom of the chair 20 and the object 110 is placed in the pouch 104.

With respect to the above description then, it is to be realized that the optimum dimensional relationships for the parts of an embodiment enabled by the disclosure, to include variations in size, materials, shape, form, function and manner of operation, system and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

We claim:

1. A wheelchair adornment system comprising:

a wheelchair having a pair of wheels, a pair of arm rests, a pair of leg supports, a chair and a backrest;

a plurality of guards, each of said guards being removably coupled to a selected point on said wheelchair wherein each of said guards is configured to conceal associated parts of a user's body, wherein each of said guards comprises a panel having a first lateral edge and a second lateral edge, each of said panels being concavely arcuate between said first lateral edge and said second lateral edge such that said first lateral edge is spaced from said second literal edge;

a pair of fenders, each of said fenders being coupled to said wheelchair, each of said fenders being positioned over an associated one of said wheels;

a canopy being removably coupled to said wheelchair wherein said canopy is configured to shade the user; and a pair of mounts, each of said mounts having a leg and a foot, said leg corresponding to each of said mounts being hingedly coupled to said first lateral edge having said foot corresponding to each of said mounts being spaced from said corresponding mount, said foot corresponding to each of said mounts having a distal end with respect to said leg of said corresponding mount.

2. The system according to claim 1, wherein each of said mounts has a ring being coupled to said distal end of said foot of said corresponding mount, said ring engaging said wheelchair such that said panel is retained on said wheelchair.

3. The system according to claim 2, wherein said plurality of guards includes a pair of arm guards and a pair of leg guards, said ring of each of said mounts corresponding to each of said arm guards being coupled to an associated one of a pair of supports of an associated one of said arm rests having said panel of said corresponding mount being spaced from said associated arm rest wherein each of said arm guards is configured to conceal an associated one of the user's arms.

4. The system according to claim 3, wherein said ring of each of said mounts corresponding to each of said leg guards being coupled to an associated one of said leg supports having said panel of said corresponding mount being spaced from said associated leg support wherein each of said leg guards is configured to conceal an associated one of the user's legs.

5. The system according to claim 1, wherein each of said fenders has a primary lateral edge and a secondary lateral edge, each of said fenders being concavely arcuate between said primary lateral edge and said secondary lateral edge.

6. The system according to claim 5, wherein each of said fenders includes a grip, said grip corresponding to each of said fenders being coupled to and being coextensive with said corresponding fender, said grip corresponding to each of said fenders having a leg and a foot, said foot corresponding to each of said fenders being spaced from said corresponding fender to define a frame space in said corresponding fender, said frame space of said corresponding fender receiving a frame of said wheelchair such that each of said fenders is retained on said wheelchair.

7. The system according to claim 1, wherein said canopy comprises a first frame having a central arm extending between a pair of outward arms, said outward arms being spaced from each other, each of said outward arms having a distal end with respect to said central arm.

8. The system according to claim 7, further comprising a second frame having a middle arm extending between a pair of outside arms, said outside arms being spaced apart from each other, each of said outside arms having a distal end with respect to said middle arm, said distal end corresponding to each of said outside arms being hingedly coupled to said distal end corresponding to an associated one of said outward arms to define a pair of hinge points on said canopy.

9. The system according to claim 8, further comprising a pair of brackets, each of said brackets being coupled to an associated one of said hinge points, each of said brackets engaging said back rest on said wheel chair such that said canopy extends upwardly from said back rest.

10. The system according to claim 8, further comprising a cover being coupled between said first frame and said second frame wherein said cover is configured to shade the user, said cover being comprised of a deformable material.

11. The system according to claim 7, further comprising a plurality of fasteners, each of said fasteners being coupled to said first frame, said fasteners being spaced apart from each other and being distributed along said first frame.

12. The system according to claim 1, further comprising a pair of disks, each of said disks having a first surface and a second surface, each of said disks being removably coupled to an associated one of said wheels on said wheelchair having said first surface of each of said disks abutting said associated wheel.

13. The system according to claim 12, wherein said second surface of each of said disks has indicia being printed thereon, said indicia comprising an image wherein each of said disks is configured to enhance an ornamental appearance of said wheelchair.

14. The system according to claim 1, further comprising:

a pouch being secured to a bottom side of said chair, said pouch having a top side and a first edge, said first edge being open to access an interior of said pouch wherein said first edge is configured to receive an object;

a closure being movably coupled to said first edge wherein said closure is configured to be manipulated, said closure selectively closing said first edge; and a plurality of hangers, each of said hangers being coupled to said top side of said pouch, said hangers being spaced apart from each other and being distributed around a perimeter of said pouch, each of said hangers engaging said bottom side of said chair.

15. A wheelchair adornment system comprising:

a wheelchair having a pair of wheels, a pair of arm rests, a pair of leg supports, a chair and a backrest;

a plurality of guards, each of said guards being removably coupled to a selected point on said wheelchair wherein each of said guards is configured to conceal associated parts of a user's body, each of said guards comprising:

a panel having a first lateral edge and a second lateral edge, each of said panels being concavely arcuate between said first lateral edge and said second lateral edge such that said first lateral edge is spaced from said second lateral edge, and a pair of mounts, each of said mounts having a leg and a foot, said leg corresponding to each of said mounts being hingedly coupled to said first lateral edge having said foot corresponding to each of said mounts being spaced from said corresponding mount, said foot corresponding to each of said mounts having a distal end with respect to said leg of said corresponding mount, each of said mounts having a ring being coupled to said distal end of said foot of said corresponding mount, said ring engaging said wheelchair such that said panel is retained on said wheelchair;

said plurality of guards including a pair of arm guards and a pair of leg guards, said ring of each of said mounts corresponding to each of said arm guards being coupled to an associated one of a pair of supports of an associated one of said arm rests having said panel of said corresponding mount being spaced from said associated arm rest wherein each of said arm guards is configured to conceal an associated one of the user's arms, said ring of each of said mounts corresponding to each of said leg guards being coupled to an associated one of said leg supports having said panel of said corresponding mount being spaced from said associated leg support wherein each of said leg guards is configured to conceal an associated one of the user's legs;

a pair of fenders, each of said fenders being coupled to said wheelchair, each of said fenders being positioned over an associated one of said wheels, each of said fenders having a primary lateral edge and a secondary lateral edge, each of said fenders being concavely arcuate between said primary lateral edge and said secondary lateral edge, each of said fenders including a grip, said grip corresponding to each of said fenders being coupled to and being coextensive with said corresponding fender, said grip corresponding to each of said fenders having a leg and a foot, said foot corresponding to each of said fenders being spaced from said corresponding fender to define a frame space in said corresponding fender, said frame space of said corresponding fender receiving a frame of said wheelchair such that each of said fenders is retained on said wheelchair;

a canopy being removably coupled to said wheelchair wherein said canopy is configured to shade the user, said canopy comprising:

a first frame having a central arm extending between a pair of outward arms, said outward arms being spaced from each other, each of said outward arms having a distal end with respect to said central arm, a second frame having a middle arm extending between a pair of outside arms, said outside arms being spaced apart from each other, each of said outside arms having a distal end with respect to said middle arm, said distal end corresponding to each of said outside arms being hingedly coupled to said distal end corresponding to an associated one of said outward arms to define a pair of hinge points on said canopy, a pair of brackets, each of said brackets being coupled to an associated one of said hinge points, each of said brackets engaging said back rest on said wheel chair such that said canopy extends upwardly from said back rest, a cover being coupled between said first frame and said second frame wherein said cover is configured to shade the user, said cover being comprised of a deformable material, and a plurality of fasteners, each of said fasteners being coupled to said first frame, said fasteners being spaced apart from each other and being distributed along said first frame;

a pair of disks, each of said disks having a first surface and a second surface, each of said disks being removably coupled to an associated one of said wheels on said wheelchair having said first surface of each of said disks abutting said associated wheel, said second surface of each of said disks having indicia being printed thereon, said indicia comprising an image wherein each of said disks is configured to enhance an ornamental appearance of said wheelchair;

a net being removably coupled to said fasteners on said first frame such that said net substantially surrounds said wheelchair wherein said net is configured to inhibit insects from biting the user;

a pouch being secured to a bottom side of said chair, said pouch having a top side and a first edge, said first edge being open to access an interior of said pouch wherein said first edge is configured to receive an object;

a closure being movably coupled to said first edge wherein said closure is configured to be manipulated, said closure selectively closing said first edge; and a plurality of hangers, each of said hangers being coupled to said top side of said pouch, said hangers being spaced apart from each other and being distributed around a perimeter of said pouch, each of said hangers engaging said bottom side of said chair.

* * * * *